US009449551B2

(12) United States Patent
Lee et al.

(10) Patent No.: US 9,449,551 B2
(45) Date of Patent: Sep. 20, 2016

(54) ORGANIC LIGHT EMITTING DIODE DISPLAY

(71) Applicant: Samsung Display Co., Ltd., Yongin, Gyeonggi-Do (KR)

(72) Inventors: Jae-Hoon Lee, Yongin (KR); Do-Ik Kim, Yongin (KR); Baek-Woon Lee, Yongin (KR)

(73) Assignee: Samsung Display Co., Ltd., Yongin (KR)

( * ) Notice: Subject to any disclaimer, the term of this patent is extended or adjusted under 35 U.S.C. 154(b) by 217 days.

(21) Appl. No.: 13/963,971

(22) Filed: Aug. 9, 2013

(65) Prior Publication Data

US 2014/0292822 A1 Oct. 2, 2014

(30) Foreign Application Priority Data

Mar. 26, 2013 (KR) ..... 10-2013-0032241

(51) Int. Cl.
*G09G 3/3233* (2016.01)
*G09G 3/32* (2016.01)
*G09G 3/20* (2006.01)

(52) U.S. Cl.
CPC ..... *G09G 3/3233* (2013.01); *G09G 3/2003* (2013.01); *G09G 2300/0426* (2013.01); *G09G 2320/0242* (2013.01); *G09G 2330/00* (2013.01); *G09G 2330/028* (2013.01)

(58) Field of Classification Search
CPC ..... G09G 3/32
See application file for complete search history.

(56) References Cited

U.S. PATENT DOCUMENTS

2007/0069992 A1* 3/2007 Smith ..... G09G 3/2014 345/76
2009/0315814 A1* 12/2009 Tomida et al. ..... 345/76

FOREIGN PATENT DOCUMENTS

KR 10-2006-0125634 A 12/2006
KR 10-2011-0068653 A 6/2011
KR 10-2012-0019016 A 3/2012

* cited by examiner

*Primary Examiner* — Alexander Eisen
*Assistant Examiner* — Cory Almeida
(74) *Attorney, Agent, or Firm* — Knobbe Martens Olson & Bear LLP

(57) ABSTRACT

An organic light emitting diode (OLED) display includes a display unit including first pixels emitting first color light, second pixels emitting second color light, and third pixels emitting third color light, and a power source voltage supplier supplying a driving voltage to the respective pixels of the display unit. The display further includes a first voltage wire transferring the driving voltage to the first pixels, a second voltage wire transferring the driving voltage to the second pixels, and a third voltage wire transferring the driving voltage to the third pixels. The first, second and third voltage wires being provided in a first layer. The display includes auxiliary voltage wires provided in a second layer different from the first layer. Contact areas between the first, second and third voltage wire and the auxiliary voltage wires are different from each other.

10 Claims, 5 Drawing Sheets

ORGANIC LIGHT EMITTING DIODE DISPLAY

CROSS-REFERENCE TO RELATED APPLICATION

This application claims priority to and the benefit of Korean Patent Application No. 10-2013-0032241 filed in the Korean Intellectual Property Office on Mar. 26, 2013, the entire contents of which are incorporated herein by reference.

BACKGROUND (a) Field

The present disclosure relates to an organic light emitting diode (OLED) display.

(b) Discussion of the Related Technology

An organic light emitting diode (OLED) display includes two electrodes and an organic emission layer disposed between the two electrodes. Electrons injected from one electrode and holes injected from the other electrode are combined in an organic emission layer to form exiton so that the exiton generates energy to emit light.

The organic light emitting diode (OLED) display includes a plurality of pixels having an organic light emitting diode being a light emitting device. Each of the pixels includes a plurality of thin film transistors for driving the organic light emitting diode (OLED) and at least one capacitor.

In the recent trend of a large area, an organic light emitting diode (OLED) display is fabricated to have a display panel with a large area. As the OLED display is located away from the power supply, voltage drop occurs due to resistance in a driving voltage line disposed on the entire surface of a display panel to transfer a driving voltage of the OLED display from a power supply. In general, in order to prevent voltage drop, a driving voltage line of the organic light emitting diode (OLED) display has a mesh structure which includes a vertical driving voltage line and a horizontal driving voltage line.

Meanwhile, the voltage drop in the display panel causes luminance non-uniformity by colors and color coordinate deviation due to different luminous efficiency characteristics according to colors of pixels such as a red pixel, a green pixel, and blue pixel.

The above information disclosed in this Background section is only for enhancement of understanding of the background of the invention and therefore it may contain information that does not form the prior art that is already known in this country to a person of ordinary skill in the art.

SUMMARY

One aspect of the present invention provides an OLED display having advantages of improving color coordinate deviation of image display caused due to differences of required current amounts according to red, green, and blue pixels. An exemplary embodiment of the present invention provides an OLED display for providing a high-quality image maintaining uniformity of color characteristics such as a luminance and a color coordinate in an entire region of the OLED display.

An embodiment of the present invention provides an organic light emitting diode (OLED) display including: a display unit including a plurality of first pixels configured to emit first color light, a plurality of second pixels configured to emit second color light, a plurality of third pixels configured to emit third color light, and the display unit being configured to display images based on image data signals; a power source voltage supplier configured to apply driving voltage to the respective pixels of the display unit; a first voltage wire configured to transfer the driving voltage to the plurality of first pixels; a second voltage wire configured to transfer the driving voltage to the plurality of second pixels; a third voltage wire configured to transfer the driving voltage to the plurality of third pixels, the first, second and third voltage wires being provided in a first layer; and a plurality of auxiliary voltage wires provided in a second layer different from the first layer, each of the plurality of auxiliary voltage wires contacting a corresponding one of the first, second and third voltage wires and being configured to transfer the driving voltage. Contact areas between the first voltage wire and the corresponding auxiliary voltage wire, between the second voltage wire and the corresponding auxiliary voltage wire, between the third voltage wire and the corresponding auxiliary voltage wire may be different from each other.

The contact areas may be determined based on luminous efficiency of the first pixels, the second pixels, and the third pixels.

Each of the first, second and third pixels has a value of luminous efficiency of the first, second and third pixels, the contact area between the auxiliary voltage wire and the voltage wire corresponding to a pixel having the smallest value of the luminous efficiency has a greatest value among values of the contact areas.

The first, second and third voltage wires may be provided over the plurality of auxiliary voltage wires, but is not limited thereto.

The first layer may comprise portions configured to transfer the driving voltage to source or drain electrodes of thin film transistors of the plurality of first, second and third pixels, and the second layer may comprise portions configured to transfer the driving voltage to gate electrodes of the thin film transistors. The first color light, the second color light, and the third color light may be red light, green light, and blue light, respectively.

The third pixels among the first, second and third pixels may have the least luminous efficiency.

The display may further comprise additional voltage wires, each of which is connected to a corresponding one of the first, second and third voltage wires through at least one contact hole and extends perpendicular to the corresponding one of the first, second and third voltage wires.

The display may further comprise additional voltage wires, and the first, second and third voltage wires and the additional voltage wires, in combination, may have a mesh structure.

The power source voltage supplier may include a plurality of power source voltage supply devices configured to apply the driving voltage to the plurality of first pixels, the plurality of second pixels, and the plurality of third pixels.

According to embodiments of the present invention, a required current amount and a voltage drop ratio on a panel region can be adjusted depending on red, green, and blue pixels, thereby improving color coordinate deviation of colors. Accordingly, a high-quality image can be provided while maintaining color characteristics such as uniform luminance and color coordinate on an entire panel region in the OLED display.

DETAILED DESCRIPTION OF EMBODIMENTS

In the following detailed description, the present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

For the purpose of clearly describing an exemplary embodiment of the present invention, parts which are not related to the description are omitted. The same reference numbers are used throughout the specification to refer to the same or like parts.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion of any other elements.

Figure 1:
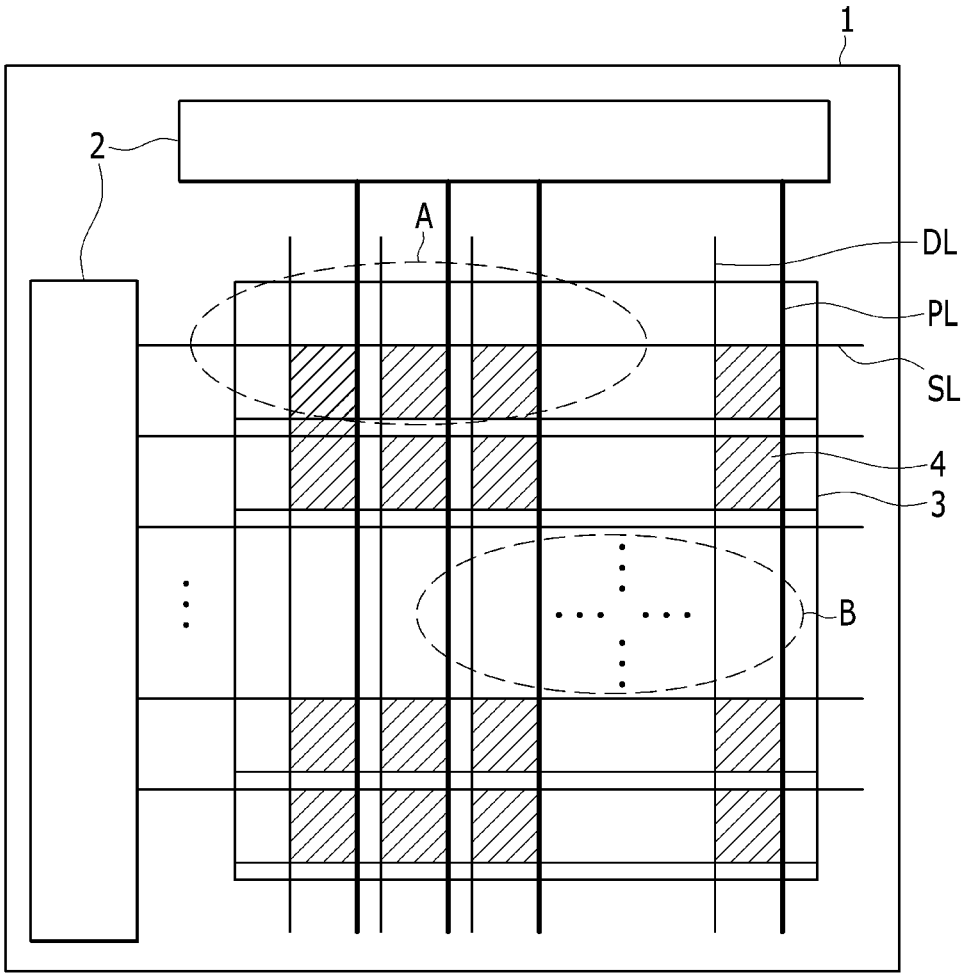
FIG. 1 is a block diagram schematically illustrating an OLED display according to an exemplary embodiment of the present invention.

FIG. 1 is a block diagram schematically illustrating an OLED display according to an exemplary embodiment of the present invention.

Referring to FIG. 1, the OLED display according to an exemplary embodiment of the present invention includes a display panel 1 which has a display area displaying an image and a non-display area composed of a driver driving the display area to implement the image. A driver corresponding to the non-display area may be separately configured at an outer region of the display panel 1.

In detail, the display panel 1 of the OLED display includes a display unit 3 configured by a plurality of pixels displaying an image corresponding to an image data signal based on an external video signal and a driving circuit 2 driving the plurality of pixels.

Although not shown in FIG. 1, a controller controlling operations of the driving circuit 2 and the display unit 3 may be separately configured or may be included in the driving circuit 2.

Further, the driving circuit 2 includes a scan driver generating and supplying scan signals for activating a plurality of pixels included in the display unit 3, and a data driver transferring data voltage based on image data signals corresponding to the plurality of pixels activated in response to the scan signals.

Further, for better understanding and ease of description, it is shown in FIG. 1 that the driving circuit 2 includes a power source voltage supplier supplying a driving voltage to a plurality of pixels of the display unit 3 and the driving circuit 2. In addition, as shown in FIG. 1, the power source voltage supplier of the driving circuit 2 is connected to respective pixels of the display unit 3 through a plurality of voltage supply lines PL.

The display unit 3 includes a plurality of pixels. One of the pixels includes a red sub-pixel generating red light in response to a driving current corresponding to an image data signal, a green sub-pixel green generating green light, and blue sub-pixel generating blue light.

In this case, the power source voltage driver may include a plurality of power source voltage drivers to supply a driving voltage to a plurality of sub-pixels by colors or may include one power source voltage driver to supply a driving voltage to the entire pixels.

In FIG. 1, a plurality of sub-pixel 4 of the display unit 3 are arranged in a region where a plurality of scan lines SL, a plurality of data lines DL, and a plurality of voltage supply lines PL vertically crossing each other on the display panel 1 are defined. The plurality of data lines DL are spaced apart from the plurality of voltage supply lines PL by a predetermined distance while being interposed a corresponding sub-pixel 4 therebetween. The plurality of data line DL and the plurality of voltage supply lines PL are disposed parallel with each other in one direction.

Each of the plurality of sub-pixels 4 in the display unit 3 is connected to a corresponding scan line of the plurality of scan lines, a corresponding data line of the plurality of data lines, and a corresponding voltage supply line of the plurality of voltage supply lines.

The plurality of scan lines SL are connected to the scan driver of the driving circuit 2, and the plurality of data lines DL are connected to the data driver of the driving circuit 2. For better understanding and ease of description, a connection structure of the plurality of data lines DL to the data driver is omitted.

Further, the plurality of voltage supply lines PL are connected to the power source voltage supplier of the driving circuit 2.

Although FIG. 1 has illustrated that a horizontally disposed driving circuit of the driving circuits 2 is designated as a power source voltage supplier and a plurality of voltage supply lines PL extend from the power source voltage supplier to a plurality of sub-pixels 4 of the display unit 3, the present invention is not limited to the above embodiment.

According to an arrangement construction of another exemplary embodiment, a main driving voltage supply line is disposed along an edge of the display unit 3, and a sub-driving voltage supply line connected to the main driving voltage supply line may be included to have a mesh structure.

In even some exemplary embodiments where a driving voltage supply line is disposed, a first region is disposed closer to the power source voltage supplier and a second region is formed away from the power source voltage supplier. The exemplary embodiment of FIG. 1 symbolically illustrates a first region A close to the power source voltage supplier and a second region B located away from the power source voltage supplier. Resistance due to a voltage supply line is gradually increased from a plurality of sub-pixels included in the first region A to a plurality of sub-pixels included in the first region A, voltage drop (IR drop) is increased.

That is, as the size of the OLED display has become enlarged, lengths of the plurality of voltage supply lines PL are gradually increased. Accordingly, luminance of sub-pixels of the second region B becomes lower than luminance of sub-pixels of the first region A caused by voltage drop due to wire resistance. Luminance non-uniformity occurs in a large display panel due to the foregoing voltage drop.

In addition, when the OLED display in accordance with embodiments of the present invention including a plurality of sub-pixels by colors constituting one pixel is driven, required driving current amounts and luminous efficiency vary according to red, green and blue colors so that voltage drop rates are changed according to colors. Accordingly, upon implementing an image on a large sized display panel, there is a difference between implementation of a real color coordinate of sub-pixels in the first region A located near the power source voltage driver and implementation of a color coordinate of sub-pixels in the second region B located away from the power source voltage driver so that color coordinate deviation in the display panel may be at least 30 times of an allowable reference value.

Luminance non-uniformity and color coordinate deviation in the display panel due to voltage drop and differences in the required current amount of sub-pixels and luminous efficiency by colors deteriorate the optical characteristic quality of image display.

The OLED display according to an exemplary embodiment of the present invention adjusts a driving voltage supply line so that a voltage drop ratio between the plurality of sub-pixels between the first region A representing regions close to the power source voltage driver and the second region B representing regions located away from the power source voltage driver are changed according to colors, thereby compensating luminance non-uniformity and color coordinate deviation.

Figure 2:
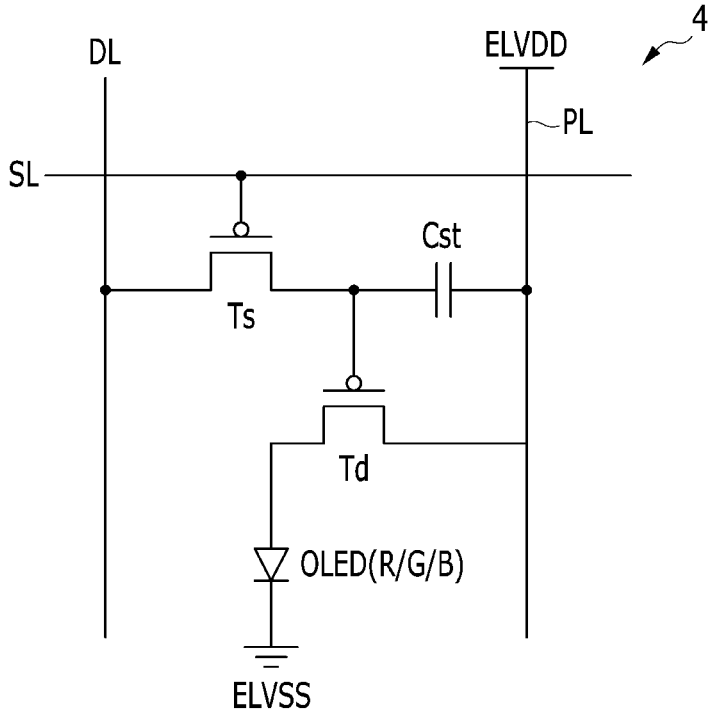
FIG. 2 is a circuit diagram schematically illustrating a circuit arrangement of a sub-pixel of FIG. 1 according to an exemplary embodiment of the present invention.

FIG. 2 is a circuit diagram schematically illustrating a circuit arrangement of a sub-pixel 4 of FIG. 1. A pixel circuit arrangement of an exemplary embodiment shown in FIG. 2 is connected to the scan line SL, the data line DL, the driving voltage supply line PL and is configured as a minimum circuit device emitting one of red light, green light, and blue light, but is not limited thereto. Accordingly, the pixel circuit arrangement includes a plurality of thin film transistors and a capacitor to provide various circuit designs.

Referring to FIG. 2, a sub-pixel 4 of FIG. 1 includes a pixel driver having two thin film transistors and one capacitor, and an organic light emitting diode (OLED) of a stack structure having an anode, an organic emission layer, and a cathode.

The pixel driver includes a circuit device supplying a driving current for an image data signal to an organic light emitting diode (OLED), and the organic light emitting diode (OLED) is a light emitting device emitting one of red light, green light, and blue light in response to the driving current.

The pixel driver includes a driving transistor Td, a switching transistor Ts, and a storage capacitor Cst.

The driving transistor Td serves to receive a data voltage based on an image data signal and to transfer a driving current corresponding to the data signal to the organic light emitting diode (OLED).

The driving transistor Td includes a first electrode connected to a voltage supply line PL supplying or applying a first power source voltage ELVDD, a second electrode connected to an anode of the organic light emitting diode OLED, and a gate electrode connected to the voltage supply line PL supplying the first power source voltage ELVDD through a storage capacitor Cst.

The switching transistor Ts is turned-on in response to a scan signal corresponding to a sub-pixel 4 to activate the sub-pixel 4, and transfers a data voltage for a corresponding image data signal through a data line to the gate electrode of the driving transistor Td and one electrode of a storage capacitor Cst.

The switching transistor Ts includes a first electrode connected to a corresponding data line DL transferring a corresponding image data signal, a second electrode connected to a contact point between a gate electrode of the driving transistor Td and one electrode of the storage capacitor Cst, and a gate electrode connected to a corresponding scan line SL transferring a corresponding scan signal.

A configuration type of thin film transistor of the driving transistor Td and the switching transistor Ts may be a PMOS transistor as illustrated in FIG. 2, but is not limited thereto. That is, the driving transistor Td and the switching transistor Ts may be configured by an NMOS transistor.

The first electrode and the second electrode function as a source electrode or a drain electrode according to a configuration type of the thin film transistor of the pixel driver.

Meanwhile, the storage capacitor Cst in the pixel driver is provided between the driving transistor Td and a voltage supply line PL supplying the first power source voltage to store and maintain a voltage corresponding to a difference in voltages applied to both electrodes of the storage capacitor Cst. In detail, the storage capacitor Cst includes one electrode connected to a contact point to which the gate electrode of the driving transistor Td and the second electrode of the switching transistor Ts are connected and another electrode connected to the voltage supply line PL supplying the first power source voltage ELVDD.

Accordingly, the storage capacitor Cst stores a voltage corresponding to an image data signal between both electrodes of the storage capacitor Cst, that is, the first electrode and the gate electrode of the driving transistor Td, thereby maintaining a voltage necessary for light emission of the organic light emitting diode (OLED).

The organic light emitting diode (OLED) includes an anode connected to the second electrode of the driving transistor Td, a cathode connected to a voltage supply line of the second power source voltage ELVSS, and an organic emission layer stacked between the anode and cathode to generate light of brightness corresponding to a driving current according to the image data signal. The organic emission layer emits light of a color corresponding to a sub-pixel among red (R), green (G) and blue (B) by the driving current.

That is, the organic emission layer includes a red organic emission layer for emitting red light, a green organic emission layer for emitting green light, and a blue organic emission layer for emitting blue light. The red organic emission layer, the green organic emission layer, and the blue organic emission layer are formed in the red sub-pixel, the green sub-pixel, and the blue sub-pixel, respectively, so that a color image is implemented.

Further, in the organic emission layer, the red organic emission layer, the green organic emission layer, and the blue organic emission layer are simultaneously stacked in the red sub-pixel, the green sub-pixel, and the blue sub-pixel, and a red color filter, a green color filter, and a blue color filter are provided by sub-pixels so that the color image may be implemented. As another example, a white organic emission layer emitting white light is formed in the red sub-pixel, the green sub-pixel, and the blue sub-pixel, the red color filter, the green color filter, and the blue color filter are provided by sub-pixels so that the color image may be implemented. When implementing a color image using the organic emission layer and the color filter, there is no need for deposition masks for depositing the red organic emission layer, the green organic emission layer, and the blue organic emission layer to respective individual sub-pixels, that is, the red sub-pixel, the green sub-pixel, and the blue sub-pixel.

The white organic emission layer described in another example may be formed in one organic emission layer, and may include a construction for emitting white light by stacking a plurality of organic emission layers. For example, the white organic emission layer includes a configuration to emit white light by a combination of at least one yellow organic emission layer and at least one blue organic emission layer, a configuration to emit white light by a combination of at least one cyan organic emission layer and at least one red organic emission layer, and a configuration to emit white light by a combination of at least one magenta organic emission layer and at least one green organic emission layer.

A sub-pixel 4 shown in FIG. 2 may include a red sub-pixel having an organic light emitting diode OLED(R) emitting red light, a green sub-pixel having an organic light emitting diode OLED(G) emitting green light, and a blue sub-pixel having an organic light emitting diode OLED(B) emitting blue light by a driving current.

A driving current necessary to display target luminance varies according to the red sub-pixel, green sub-pixel, blue sub-pixel in the display unit 3 of FIG. 1. Accordingly, there is a difference in the luminous efficiency as a function of driving current and luminance or brightness. In embodiments, the luminous efficiency may be defined as a function of luminance or brightness with respect to driving current. Such a difference may be known through a graph of FIG. 3.

Figure 3:
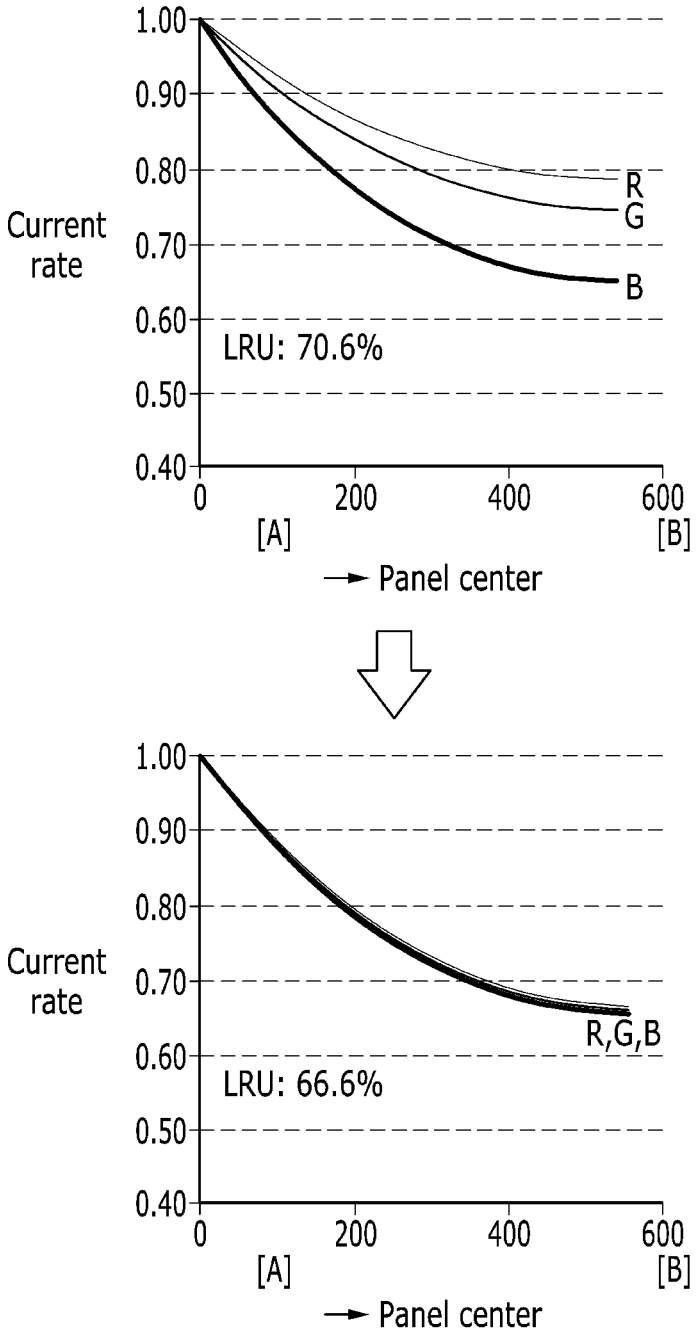
FIG. 3 is a graph illustrating a principle of improving color coordinate deviation in an OLED display according to an exemplary embodiment of the present invention.

That is, FIG. 3 illustrates a graph showing color coordinate deviation of a display panel according to the related art and a graph showing improved color coordinate characteristic in the display panel of the present invention to represent a principle of improving color coordinate deviation in an OLED display according to an exemplary embodiment of the present invention.

An upper graph of FIG. 3 illustrates color coordinate deviation in display panel of an organic light emitting diode (OLED) display according to the related art, which indicates a current rate of a sub-pixel by colors in the first region A near the power source voltage supplier and the second region B located away from the power source voltage supplier.

A horizontal axis is described as an example of a central part of the display panel, and the horizontal axis refers to a distance spaced apart from the power source voltage supplier. The vertical axis is a current rate, which is a ratio of a current amount corresponding to really emitted light with respect to a driving current amount for an applied image data signal. The current rate may be substituted by luminous efficiency for each color sub-pixel.

Referring to FIG. 3, although a power source voltage supplier equally supplies a constant driving voltage to sub-pixels by all colors to equally set a current rate by colors, the luminous efficiency varies according to the red sub-pixel, the green sub-pixel, and the blue sub-pixel, the current rate by colors is significantly changed at the second region B because of voltage drop due to a length of the voltage supply line connected to the plurality of sub-pixels.

That is, a reduction ratio of a current rate of the red sub-pixel, a reduction ratio of a current rate of the green sub-pixel, and a reduction ratio of a current rate of the red sub-pixel are significantly increased in the order of the reduction ratio of a current rate of the green sub-pixel and the reduction ratio of a current rate of the blue sub-pixel as compared with the reduction ratio of a current rate of the red sub-pixel.

Accordingly, if the display panel of the organic light emitting diode (OLED) display is located away from the power source voltage (is close to the second region B), the luminous efficiency of blue sub-pixels is deteriorated and color coordinate deviation is increased due to light emission of red sub-pixels and green sub-pixels, a yellowish phenomenon where image quality is shown with a yellow color may occur. FIG. 3 illustrates luminance of 70.6% as an example of the luminance uniformity (LRU).

The organic light emitting diode (OLED) display according to an exemplary embodiment of the present invention reduces color coordinate deviation by normalizing a degradation level of a current rate of a sub-pixel by colors to a low level as illustrated in a lower graph of FIG. 3.

In detail, the organic light emitting diode (OLED) display according to an exemplary embodiment of the present invention calculates degradation of a current rate of sub-pixels by colors of red, green, and blue by positions in the display panel, and matches a reduction ratio of a current rate of red and green sub-pixels with a reduction ratio of a current rate of a blue sub-pixel having the greatest changed reduction ratio of the current rate. To this end, a layout of the display panel is designed so that resistance in the voltage supply line connected to sub-pixels by colors may be adjusted. This will be described in detail with reference to following drawings.

Referring to the lower graph of FIG. 3, when the display panel adjusts reduction ratios of current rates of red sub-pixel and green sub-pixel by increasing resistance of the voltage supply line depending on the reduction ratio of a current rate of a plurality of blue sub-pixels, the current rate of the red sub-pixel, the green sub-pixel and the blue sub-pixel of the OLED display is similarly reduced as the red sub-pixel, the green sub-pixel and the blue sub-pixel are located away from the power source voltage supplier of organic light emitting diode (OLED) display (close to the second region B).

According to embodiments of the present invention, since the reduction ratio of a current rate of sub-pixels by colors is matched with a characteristic of the blue sub-pixel having the greatest degradation ratio, as illustrated in an example of the lower graph of FIG. 3, the luminance is lowered from 70.6% of luminance uniformity (LRU) to 66.6% thereof according to the related art. However, the present invention is advantageous in that color coordinate deviation can be solved by uniformly matching a reduction ratio of a current rate between sub-pixels by colors. Accordingly, the quality of color implementation in image implementation of the entire display panel can be improved.

Figure 4:
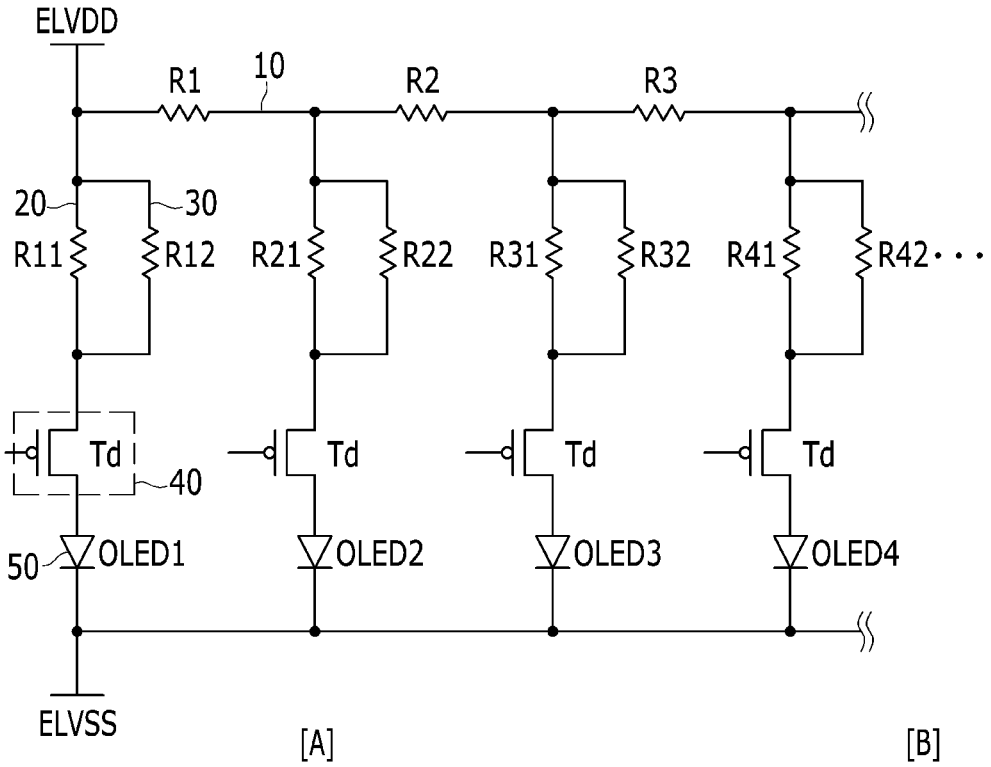
FIG. 4 is a circuit diagram illustrating a design of resistances in an OLED display according to an exemplary embodiment of the present invention.
Figure 5:
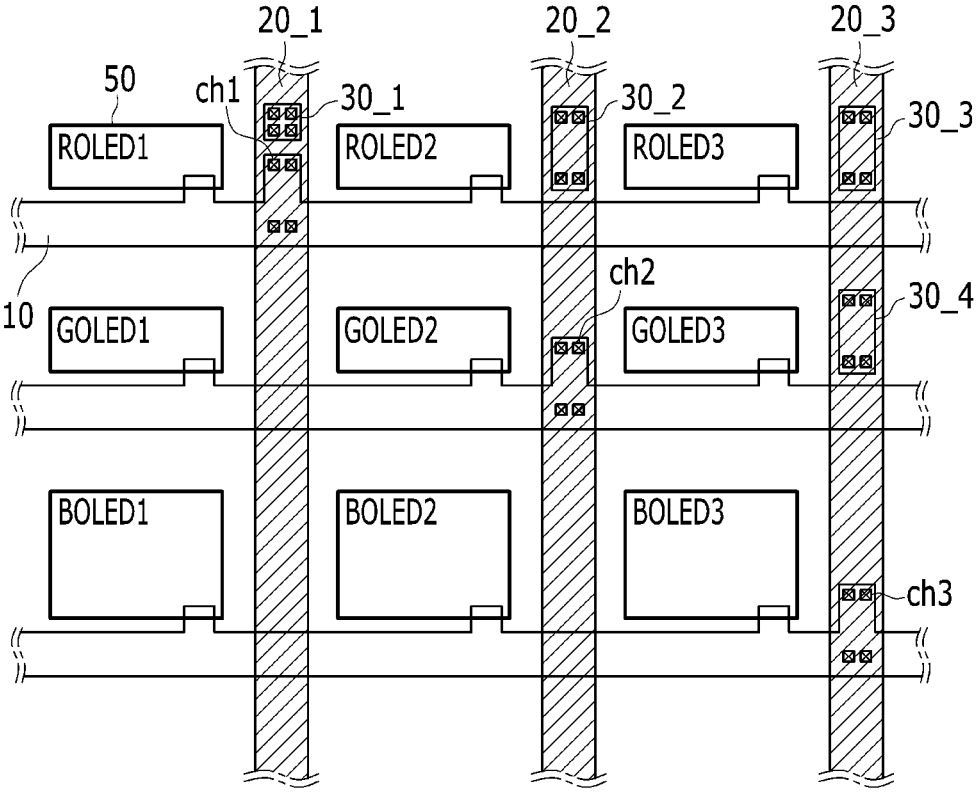
FIG. 5 is a partial layout view illustrating an OLED display of the present invention according to an exemplary embodiment shown in FIG. 4.

As illustrated in graphs of FIG. 3, a method of compensating a color coordinate by uniformly adjusting the reduction ratio of a current rate of sub-pixels by colors in the organic light emitting diode (OLED) display of the present invention adjusts resistances in voltage supply lines connected to sub-pixels by colors. FIGS. 4 and 5 illustrate a circuit diagram illustrating a design of resistances in an OLED display and a layout view illustrating some construction of an OLED display of the present invention according to an exemplary embodiment shown in FIG. 4, respectively.

In general, if a width of a supply wire of a driving power source voltage connected to red, green and blue sub-pixels is great, voltage drop is reduced during digital driving, the supply wire of a driving power source voltage is advantageous in the aspect of luminance uniformity. A scheme of reducing resistance in a supply wire of the driving power source voltage adopted in the display panel of an organic light emitting diode (OLED) display of existing digital driving is to design that a wire width is increased as a dual wire by forming another voltage supply wire metal layer below one voltage supply wire metal. Embodiments of the present invention use a dual wire structure of an existing power supply line in order to improve voltage drop of the display panel. In order to solve a difference of luminous efficiency of sub-pixels by colors, reduction ratios of current rates of sub-pixels by colors have the same as each other by adjusting a contact area between a main voltage supply line and an auxiliary voltage supply line by colors.

That is, referring to FIG. 4, according to an exemplary embodiment of the present invention, a connection structure of a voltage supply line in sub-pixels by colors of the display unit and a circuit arrangement for adjusting resistance in the voltage supply line to adjust voltage drop and a reduction ratio of a current rate may be grasped. FIG. 4 illustrates a plurality of sub-pixel structures of a display unit including the first region A close to the power source voltage supplier (a supplier for the first power source voltage ELVDD or the second power source voltage ELVSS) and the second region B located away from the power source voltage supplier.

Particularly, for better understanding and ease of description of the present invention, FIG. 4 illustrates a plurality of sub-pixels corresponding to one line among the plurality of sub-pixels included in the display unit, which schematically indicates the construction of voltage supply lines 10, 20, and 30 connected to the power source voltage supplier, a driving transistor Td 40, and an organic light emitting diode (OLED) 50 and mutual connections thereof, but remaining circuit structures are omitted.

In FIG. 4, since a length of main voltage supply line (hereinafter, referred to as 'first voltage') 10 connected to a sub-pixel is gradually increased from the first region A close to the power source voltage supplier applying the first power source voltage ELVDD or the second power source voltage ELVSS to the second region B located away from the power source voltage supplier, resistance is gradually increased. That is, the increase in the resistance may be expressed as R1, R1+R2, or R1+R2+R3.

Meanwhile, resistances in the second voltage supply lines 20 connected to the first voltage supply lines and the first electrode of a driving transistor Td (source electrode in a case of a PMOS transistor in FIG. 4) to transfer the first power source voltage to the first electrode of the driving transistor may be expressed as R11, R21, R31, and R41, respectively.

The organic light emitting diode (OLED) display according to the present invention differentially adjusts resistance in a contact area of an auxiliary voltage supply line (hereinafter, referred to as 'third voltage supply line') 30 connected to the second voltage supply line 20 in a plurality of sub-pixels by colors according to the colors. The resistance may be differently adjusted using a wire structure of supplying a dual voltage by differently adjusting contact areas of the third voltage supply line 30, R12, R22, R32, R42 connected to the second voltage supply line 20, R11, R21, R31, R41 in parallel for color sub-pixels.

In embodiments, the third voltage supply line 30 may be aligned in the same metal layer (which can be called as a gate metal layer) along with the main voltage supply line (first voltage supply line) 10 in a layout arrangement of the display unit. In this case, the gate metal layer includes the third voltage supply line and the first voltage supply line as well as a gate voltage supply portion supplying driving voltage to a gate electrode of the thin film transistor in a circuit arrangement of a sub-pixel.

Further, in embodiments, the second voltage supply line 20 may be formed in another metal layer (which can be called as a source-drain metal layer). The source-drain metal layer may include an additional portion transferring a driving voltage from the main voltage supply line to a source or drain electrode of a thin film transistor of a sub-pixel circuit of the display unit.

As an embodiment, although the first voltage supply line 10 and the third voltage supply line 30 may be stacked at a layer under the second voltage supply line 20, the stack structure is not limited thereto but may be changed. Further, as one embodiment, the first voltage supply line 10 and the second voltage supply line 20 are disposed to have a mesh structure so that a driving power source voltage may be transferred to sub-pixels of the display unit.

FIG. 4 illustrates a plurality of sub-pixels corresponding to one pixel line. Organic light emitting diodes (OLED1, OLED2, OLED3, OLED4, etc.) of each sub-pixel may include organic light emitting diode (OLED) emitting red light, organic light emitting diode (OLED) emitting green light, and an organic light emitting diode (OLED) emitting blue light by lines. An arrangement of sub-pixels by colors is not specially limited.

Red, green and blue sub-pixels are arranged by pixel lines, resistance in a wire of a voltage supply line is differently adjusted according to color sub-pixels by changing a contact area between the second voltage supply line 20 and the third voltage supply line 30 by pixel lines.

As illustrated in FIG. 3, reduction ratios of current rates of a blue sub-pixel are changed to having the greatest width. Accordingly, so as to equally match reduction ratios of current rates of a blue sub-pixel with each other, resistance in the wire is greatly set in the order of a blue sub-pixel, a green sub-pixel, and a red sub-pixel. As illustrated in FIG. 4, since the resistance in the wire of the voltage supply line may be differently set by adjusting a contact area between the second voltage supply line 20 and the third voltage supply line 30, in order to increase the resistance in the order of blue, green, and red sub-pixels, in embodiments, the contact area in a dual wire structure of the second voltage supply line 20 and the third voltage supply line 30 is increased in the order of the red, green, and blue sub-pixels. This is because resistance is reduced as an area of a conductor is increased.

FIG. 5 illustrates a layout of one embodiment where a contact area is changed according to a sub-pixel by each color in a dual structure including the second voltage supply line and the third voltage supply line.

That is, a plurality of red organic light emitting diodes ROLED1, ROLED2, and ROLED3, a plurality of green organic light emitting diodes GOLED1, GOLED2, and GOLED3, and a plurality of blue organic light emitting diodes BOLED1, BOLED2, and BOLED3 are repeatedly disposed parallel with each other in one direction on a display unit of the display panel shown in FIG. 5. For better understanding and ease of description, a circuit device of a pixel driver, that is, the construction of a thin film transistor and capacitor is omitted from a layout structure of FIG. 5.

A supply wire having a mesh structure supplying a driving power source voltage is disposed between organic light emitting diodes (OLEDs) of a sub-pixel by colors. The first voltage supply line 10 extends in the same direction as arrangement directions of the OLEDs in parallel to each other, and the second voltage supply line 20 extends approximately perpendicular to the first voltage supply line 10. However, the present invention is not limited to the above arrangement structure. That is, the arrangement structure may be changed according to an exemplary embodiment.

Further, the first voltage supply line 10 and the second voltage supply line 20 are connected to each other through a contact hole. In detail, referring to FIG. 5, the first voltage supply line 10 and the second voltage supply line 20 are connected to each other through at least one first contact hole ch1 to supply a driving voltage to a red sub-pixel (for example, a source or drain electrode of a transistor of a pixel driver). In addition, the first voltage supply line 10 and the second voltage supply line 20 are connected to each other through at least one second contact hole ch2 to supply the driving voltage to a green sub-pixel. Moreover, the first voltage supply line 10 and the second voltage supply line 20 are connected to each other through at least one third contact hole ch3 to supply the driving voltage to a blue sub-pixel.

As described above, so as to match reduction ratios of current rates of red and green sub-pixels with each other corresponding to a reduction ratio of a current rate of a blue sub-pixel, in embodiments, the resistance in a supply wire of a power source voltage is increased in the order of blue, green, red sub-pixel (R>G>B). To this end, the resistance in the wire is reduced by increasing an area of a conductor. Accordingly, the resistance in the wire may be set to be reduced by increasing a contact area of a dual wire structure of the voltage supply line connected to the sub-pixel in the order of red, green, and blue (R<G<B) as illustrated in FIG. 5.

In FIG. 5, the second voltage supply line 20 transferring the driving voltage to a red sub-pixel makes contact with a third voltage supply line 30_1 of a gate metal layer disposed below the second voltage supply line 20. Further, the second voltage supply line 20 transferring a driving voltage to a green sub-pixel makes contact with the third voltage supply line 30_2 of a gate metal layer disposed below the second voltage supply line 20. In addition, the second voltage supply line 20 transferring a driving voltage to a blue sub-pixel makes contact with the third voltage supply lines 30_3 and 30_4 of a gate metal layer disposed below the second voltage supply line 20. That is, contact areas between driving power source voltage supply wires (the second voltage supply line) connected in the order of a red sub-pixel, a green sub-pixel, and a blue sub-pixel and an auxiliary wire (the third voltage supply line) below the driving power source voltage supply wire are increased corresponding to the sizes of the third voltage supply lines 30_1, 30_2, 30_3, and 30_4, respectively. Since resistance of a conductor is reduced if an area of the conductor is increased, resistances in a power source voltage driving wire of sub-pixels by colors are reduced in the order of red, green, and blue. On the contrary, since resistances in wires of red sub-pixels are increased, a reduction ratio of a current rate due to voltage drop may be reduced to lower the same reduction ratio of a current rate as that of blue sub-pixels. Accordingly, although the whole luminance may be reduced, color coordinate deviation such as a yellowish phenomenon is significantly improved so that image quality of exact and clear color can be implemented.

A detailed description of the accompanying drawings and the invention are only an embodiment of the present invention, which are used for the purpose of describing the present invention but are not used to limit the meanings or a range of the present invention described in claims. Accordingly, those skilled in the art to which the invention pertains can easily select and substitute therefrom. A person of ordinary skill in the art may omit some constituent elements described in the specification without degradation of performance or may add constituent elements to improve performance. In addition, a person of ordinary skill in the art may change an order of steps included in the method according to a process environment or equipment. Therefore, a range of the present invention must be determined by claims and equivalents, not embodiments.

<Description of symbols>

| | |
|---|---|
| 1: display panel | 2: driving circuit |
| 3: display unit | 4: sub-pixel |
| 10: first voltage supply line | 20: second voltage supply line |
| 30: third voltage supply line | 40: driving transistor |
| 50: organic light emitting diode (OLED) | |

What is claimed is:

1. An organic light emitting diode (OLED) display comprising:

an array of pixels comprising a row of first color pixels configured to emit first color light, a row of second color pixels configured to emit second color light, a row of third color pixels configured to emit third color light;

a power source configured to supply driving voltage to the array of pixels;

a plurality of horizontal wires comprising a first horizontal wire, a second horizontal wire and a third horizontal wire, the first horizontal wire connected to the row of the first color pixels, the second horizontal wire connected to the row of the second color pixels, and the third horizontal wire connected to the row of the third color pixels, wherein the plurality of horizontal wires are provided in a first layer;

a plurality of vertical wires connected to the power source and further connected to the first, second and third horizontal wires for transferring driving voltage to the first, second and third horizontal wires from the power source, wherein the plurality of vertical wires being provided in a second layer are different from the first layer; and a plurality of auxiliary wires formed in regions overlapping the plurality of vertical wires in the first layer and parallelly connected to the vertical wires of the plurality of vertical wires for providing different resistances from the power source to the first, second and third horizontal wires.

2. The organic light emitting diode (OLED) display of claim 1, wherein the resistances from the power source to the first, second and third horizontal wires are determined based on luminous efficiencies of the first color, second color and third color pixels.

3. The organic light emitting diode (OLED) display of claim 2, wherein when a third color pixel has the lowest luminous efficiency among the first, second, and third color pixels, resistance from the power source to the third horizontal wire is the smallest among the resistances from the power source to the first, second and third horizontal wires.

4. The organic light emitting diode (OLED) display of claim 1, wherein the second layer is provided over the plurality of auxiliary wires.

5. The organic light emitting diode (OLED) display of claim 1, wherein the first layer comprises portions are configured to transfer the driving voltage to source or drain electrodes of thin film transistors of the plurality of first, second, and third color pixels, and the second layer comprises portions configured to transfer driving voltage to gate electrodes of the thin film transistors.

6. The organic light emitting diode (OLED) display of claim 1, wherein the first color light, the second color light, and the third color light are red light, green light, and blue light, respectively.

7. The organic light emitting diode (OLED) display of claim 6, wherein the third color pixels among the first, second, and third pixels have the least luminous efficiency.

8. The organic light emitting diode (OLED) display of claim 1, wherein the plurality of vertical wires and the plurality of horizontal wires are perpendicularly connected through at least one contact hole.

9. The organic light emitting diode (OLED) display of claim 1, wherein the plurality of horizontal wires and the plurality of vertical wires, in combination, have a mesh structure.

10. The organic light emitting diode (OLED) display of claim 1, wherein the power source comprises a plurality of power source voltage supply devices configured to apply the driving voltage to the row of first color pixels, the row of second color pixels, and the row of third color pixels.

* * * * *